US005926151A

United States Patent [19]

Hagiwara et al.

[11] Patent Number: 5,926,151

[45] Date of Patent: Jul. 20, 1999

[54] ANTENNA UNIT HAVING INTEGRAL RADIO TRANSMITTER-RECEIVER AND FIXED TO A BASE AFFIXABLE TO A SUPPORT STRUT

[75] Inventors: Yuuichi Hagiwara; Kazuo Kumahara; Satoshi Kotaka; Toshimitsu Kobayashi; Yoshiaki Minowa, all of Kawasaki, Japan

[73] Assignee: Fujitsu Limited, Kawasaki, Japan

[21] Appl. No.: 08/715,520

[22] Filed: Sep. 18, 1996

[30] Foreign Application Priority Data

Feb. 26, 1996 [JP] Japan ..... 8-038363

[51] Int. Cl.[6] ..... H01Q 3/02

[52] U.S. Cl. ..... 343/882; 343/757; 343/890; 343/892

[58] Field of Search ..... 343/757, 758, 343/878, 880, 882, 890, 891, 892, 881, 872; H01Q 3/02

[56] References Cited

U.S. PATENT DOCUMENTS

| | | | |
|---|---|---|---|
| 4,584,589 | 4/1986 | Bivins et al. | 343/882 |
| 4,825,218 | 4/1989 | Begout et al. | 343/882 |
| 4,860,021 | 8/1989 | Kurosawa et al. | 343/882 |
| 5,515,065 | 5/1996 | Sherwood et al. | 343/882 |
| 5,576,722 | 11/1996 | Bustillos | 343/882 |
| 5,644,320 | 7/1997 | Rossi | 343/882 |

FOREIGN PATENT DOCUMENTS

| | | |
|---|---|---|
| 0 038 788 | 10/1981 | European Pat. Off. . |
| 0 096 959 | 12/1983 | European Pat. Off. . |
| 0 268 125 | 5/1988 | European Pat. Off. . |

*Primary Examiner*—Don Wong
*Assistant Examiner*—Tho Phan
*Attorney, Agent, or Firm*—Staas & Halsey

[57] ABSTRACT

An antenna unit comprises at least one base mount metal member fixed to a strut; a fixing structural portion for rotatably fixing the at least one base mount metal member to the strut so as to be capable of rotating around the strut; an antenna integral-type radio transmitter-receiver apparatus fixed to the base mount metal member; and an elevation adjustment mechanism for adjusting an elevation of the antenna integral-type radio transmitter-receiver apparatus. An azimuth adjustment of the antenna integral-type radio transmitter-receiver apparatus is carried out by rotating the base mount metal member together with the antenna integral-type radio transmitter-receiver apparatus around the strut.

14 Claims, 5 Drawing Sheets

ANTENNA UNIT HAVING INTEGRAL RADIO TRANSMITTER-RECEIVER AND FIXED TO A BASE AFFIXABLE TO A SUPPORT STRUT

BACKGROUND OF THE INVENTION

1. Field of the Invention

The present invention generally relates to antenna units, and more particularly, to an antenna unit used in a radio communication system utilizing radio waves of extremely high frequency (EHF) such as a subscriber radio system and a cell radio system. In terms of structure, the present invention relates to a radio transmitter-receiver unit, i.e., an antenna unit having a structure in which an antenna integral-type radio transmitter-receiver apparatus is fixed to a peripheral surface of a strut.

2. Description of the Related Art

Recently, demands such as a reduction of production cost by decreasing a number of construction parts have been increasing for an antenna unit.

In general, an antenna unit is set up by carrying out azimuth adjustment and elevation adjustment in relation to another antenna unit for communicating therewith. Therefore, it is required for an antenna unit that it is capable of being adjusted using azimuth adjustment and elevation adjustment with a reduced number of construction parts.

FIGS. 1 and 2 both show an example of a conventional antenna unit 10. The antenna unit 10 has a supporting arm 12 extending horizontally from and fixed to a strut 11, an azimuth-elevation adjustment portion 13 located on one end of the supporting arm 12 and an antenna integral-type radio transmitter-receiver apparatus 14 fixed to the azimuth-elevation adjustment portion 13.

The azimuth-elevation adjustment portion 13 is comprised of a base mount 20 fixed on the supporting arm 12, a first mount 21 mounted on the base mount 20 and fixed, by screws, onto an arbitrary position in a direction indicated by the arrow A (the rotary direction of the base mount 20 around the perpendicular central axis 20*a*), a second mount 22 supported by a shaft 23 located on the side of the first mount 21 and fixed, by screws, onto an arbitrary position in a direction indicated by the arrow E (the rotary direction of the shaft 23 which is horizontal), and an elevation adjustment mechanism 24 located between the first mount 21 and the second mount 22.

The antenna integral-type radio transmitter-receiver apparatus 14 has a structure in which an antenna 30 is fixed to a radio transmitter-receiver 31. Besides the antenna 30 and the radio transmitter-receiver 31, the antenna integral-type radio transmitter-receiver apparatus 14 has a radome 32, an awning cover 33 and a fixing metal member 34.

The antenna integral-type radio transmitter-receiver apparatus 14 is fixed to the second mount 22 by fixing the fixing metal member 34 to the second mount 22.

The azimuth adjustment of the antenna unit 10 is carried out by appropriately moving the position of the screw of the first mount 21 in the direction indicated by the arrow A so that the antenna integral-type radio transmitter-receiver apparatus 14 is properly moved to a position around the perpendicular central axis 20*a*. The elevation adjustment of the antenna unit 10 is carried out by appropriately moving the position of the second mount 22 in the direction indicated by the arrow E shown in FIG. 4 so that the antenna integral-type radio transmitter-receiver apparatus 14 is properly moved to a position around the horizontal shaft 23.

SUMMARY OF THE INVENTION

Accordingly, it is a general object of this invention to provide an antenna unit in which the above-mentioned problems are eliminated.

A more specific object of the present invention is to provide an antenna unit having a reduced number of construction parts with less cost.

Another object of the present invention is to provide an antenna unit which may be easily set up without having troublesome operations such as fixing a supporting arm to a strut.

Another object of the present invention is to provide an antenna unit having a reduced weight yet satisfying requirements for an excellent antenna unit.

Yet another object of the present invention is to provide an antenna unit having excellent reliability and stability.

The objects described above are achieved by an antenna unit comprising at least one base mount metal member fixed in a holding state so as to hold a strut and an antenna integral-type radio transmitter-receiver apparatus fixed to the base mount metal member.

According to the above antenna unit, since the antenna integral-type radio transmitter-receiver apparatus is fixed to the base mount metal member which is fixed in a holding state to a strut, a number of construction parts necessary for constructing the antenna unit can be decreased.

The objects described above are also achieved by an antenna unit comprising: at least one base mount metal member fixed to a strut; a fixing structural portion for rotatably fixing the at least one base mount metal member to the strut so as to be capable of rotating around the strut; an antenna integral-type radio transmitter-receiver apparatus fixed to the base mount metal member; and an elevation adjustment mechanism for adjusting an elevation of the antenna integral-type radio transmitter-receiver apparatus; wherein an azimuth adjustment of the antenna integral-type radio transmitter-receiver apparatus is carried out by rotating the base mount metal member together with the antenna integral-type radio transmitter-receiver apparatus around the strut.

According to the above antenna unit, since the azimuth adjustment of the antenna integral-type radio transmitter-receiver apparatus may be carried out by rotating the base mount metal member together with the antenna integral-type radio transmitter-receiver apparatus around the strut, a number of construction parts necessary for constructing the antenna unit can be decreased.

The objects described above are also achieved by the above antenna unit wherein the antenna integral-type radio transmitter-receiver apparatus has at least one hooked portion and the at least one base mount metal member has a corresponding number of hook portions, the antenna integral-type radio transmitter-receiver apparatus being fixed to the at least one base mount metal member by engaging the at least one hooked portion with the hook portion.

According to the above antenna unit, since the antenna integral-type radio transmitter-receiver apparatus can simply be fixed to the base mount metal member by engaging the hooked portion with the hook portion, troublesome operations such as fastening of screws can be eliminated and the entire operation can be carried out smoothly. Also, since the antenna integral-type radio transmitter-receiver apparatus will not fall down even if an operator does not support the apparatus, the operator can perform the set up operation with safety.

The objects described above are also achieved by the above antenna unit wherein the at least one base mount metal member has an awning cover supported by a hinge at its upper portion, the awning cover being closed after the antenna integral-type radio transmitter-receiver apparatus is fixed to the at least one base mount metal member so as to cover the upper portion of the antenna integral-type radio transmitter-receiver apparatus.

According to the above antenna unit, since the awning cover can be freely opened and closed by the use of the hinge, the setting up operation of the antenna unit can easily be performed with the cover opened, and after the completion of the operation, it is simply closed to function as an awning cover.

The objects described above are also achieved by the above antenna unit wherein the antenna integral-type radio transmitter-receiver apparatus has at least one hooked portion and the at least one base mount metal member has a corresponding number of hook portions, the antenna integral-type radio transmitter-receiver apparatus being fixed to the at least one base mount metal member by engaging the at least one hooked portion with the hook portion, and the at least one base mount metal member has an awning cover with lag portions supported by a hinge at its upper portion, the awning cover being closed after the antenna integral-type radio transmitter-receiver apparatus is fixed to the at least one base mount metal member so as to cover the upper portion of the antenna integral-type radio transmitter-receiver apparatus and, at the same time, make the lag portions press the at least one hooked portion which is engaged with the hook portion of the base mount metal member.

According to the above antenna unit, since the lag portions press the hooked portion engaged with the hook portion, a danger that the hooked portion may come off the hook portion can be eliminated. Thus, the safety level of the operation may be increased.

The objects described above are also achieved by the above antenna unit further comprising a supporting metal member structural portion for supporting the at least one base mount metal member, the supporting metal member structural portion being fixed to the strut so as to mount the at least one base mount metal member.

According to the above antenna unit, since the supporting metal member structural portion is fixed to the strut and the at least one base mount metal member is mounted on the supporting metal member structural portion, the antenna integral-type radio transmitter-receiver apparatus will not slide down along the strut and the azimuth adjustment operation can be carried out smoothly. Also, the sliding down of the antenna integral-type radio transmitter-receiver apparatus can be prevented once it is fixed and the stability of the apparatus may be improved.

Other objects and further features of the present invention will be apparent from the following detailed description when read in conjunction with the accompanied drawings.

DESCRIPTION OF THE PREFERRED EMBODIMENTS

In the following, a principle and an embodiment of the present invention will be described with reference to the accompanying drawings.

Figure 1:
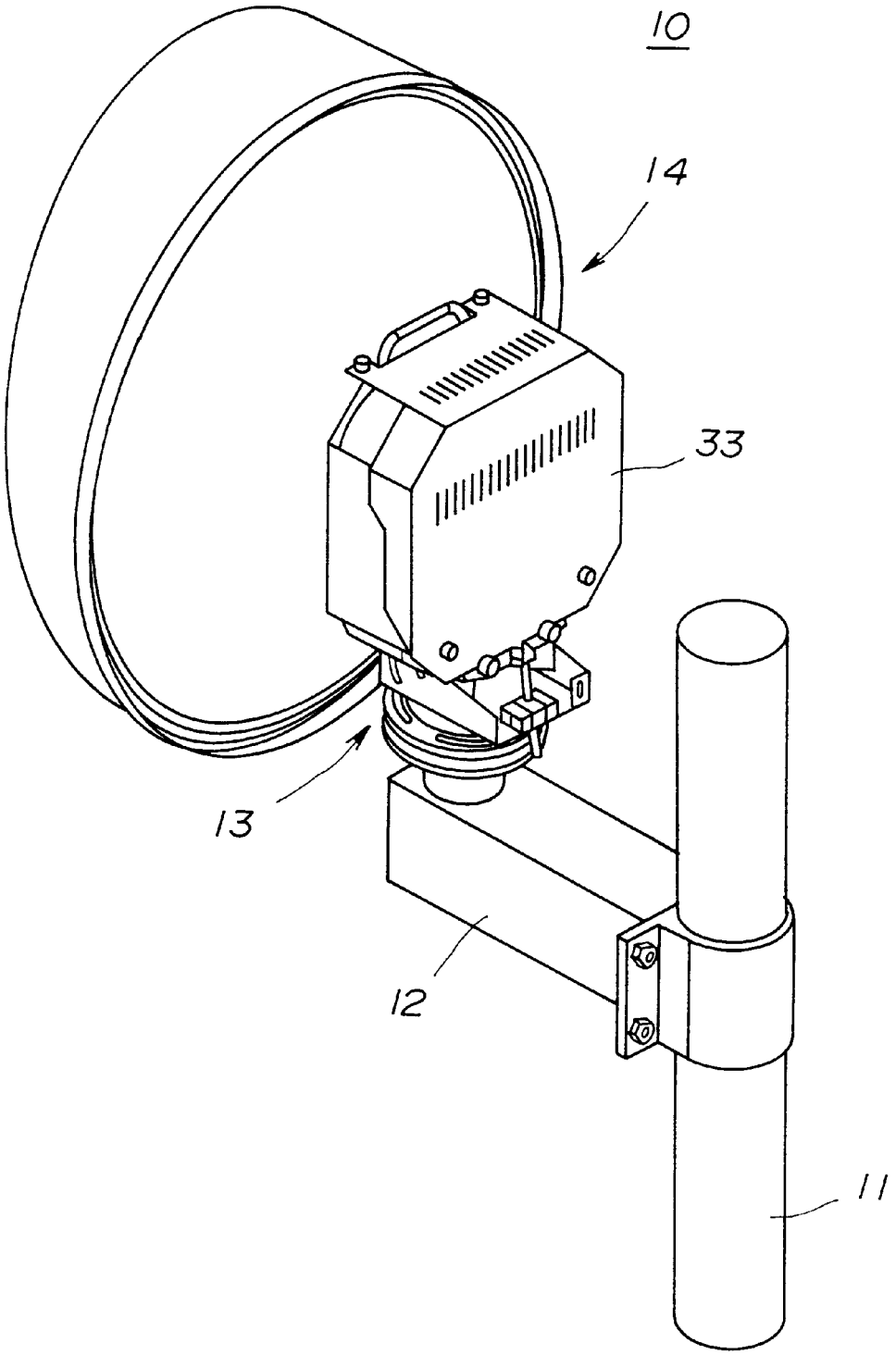
FIG. 1 PRIOR ART
FIG. 1 is a perspective view showing an embodiment of a conventional antenna unit.
Figure 2:
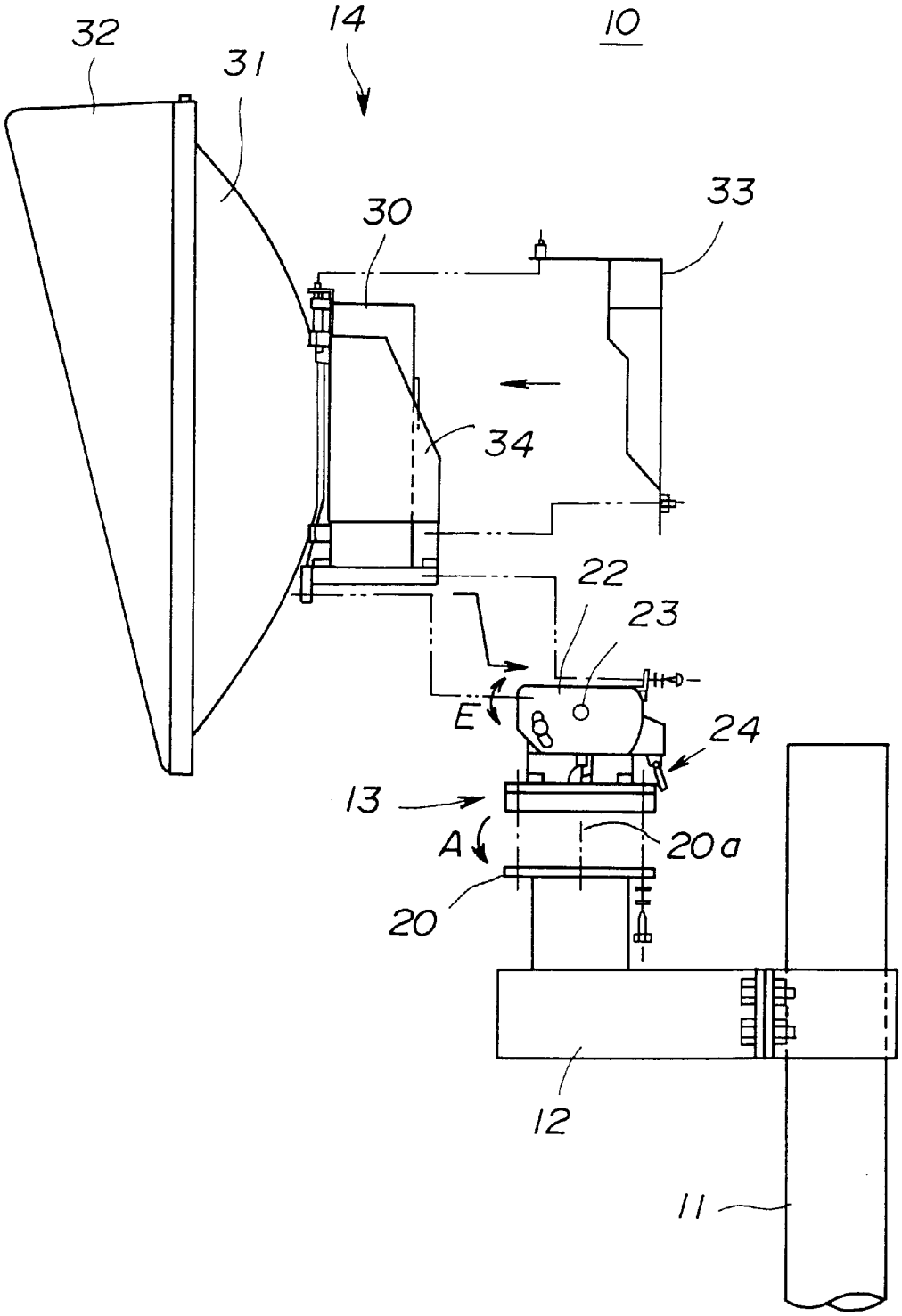
FIG. 2 PRIOR ART
FIG. 2 is an exploded view of the conventional antenna unit shown in FIG. 1.
Figure 3:
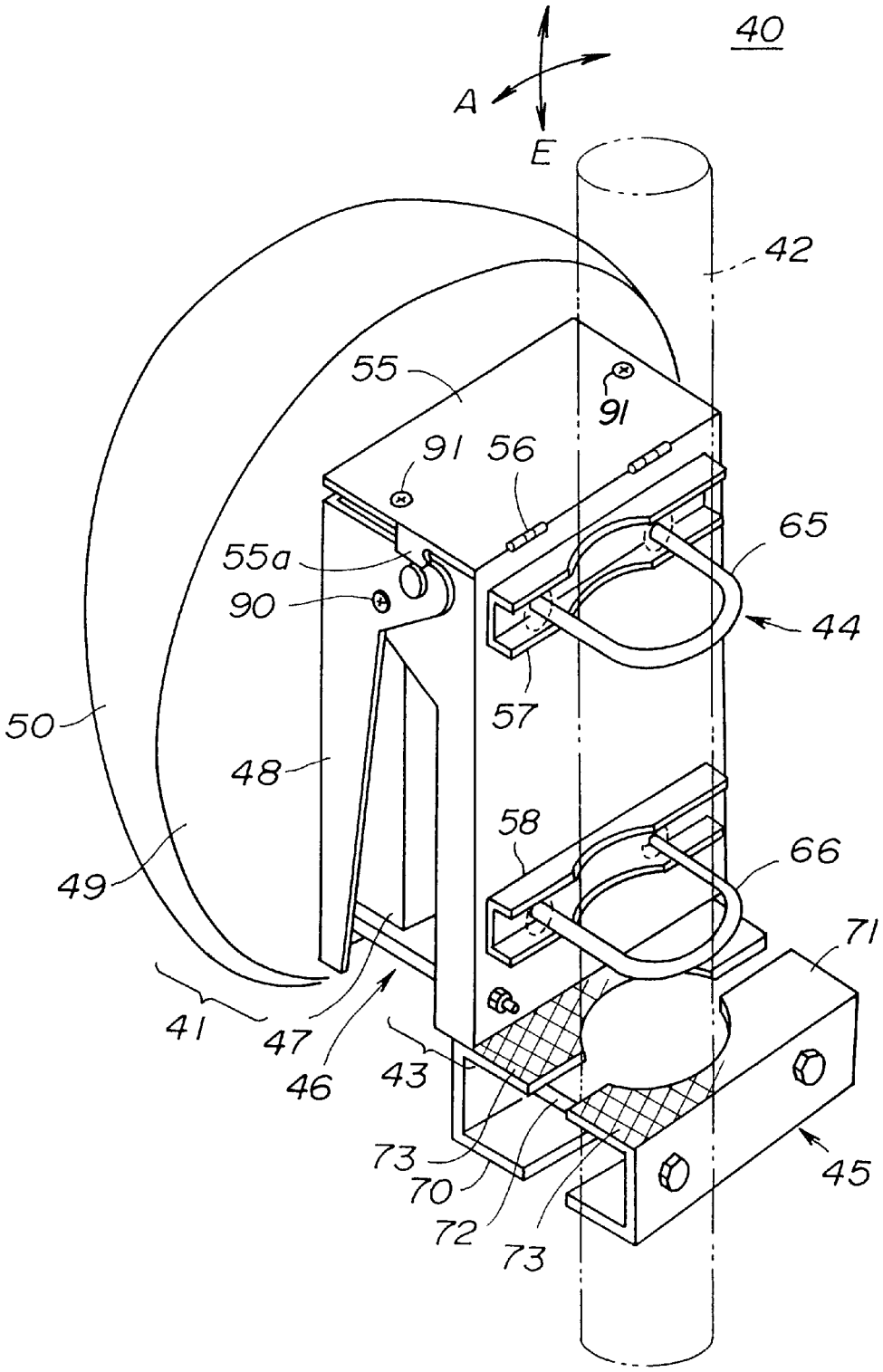
FIG. 3 is a diagram showing a perspective view of an embodiment of an antenna unit according to the present invention.
Figure 4:
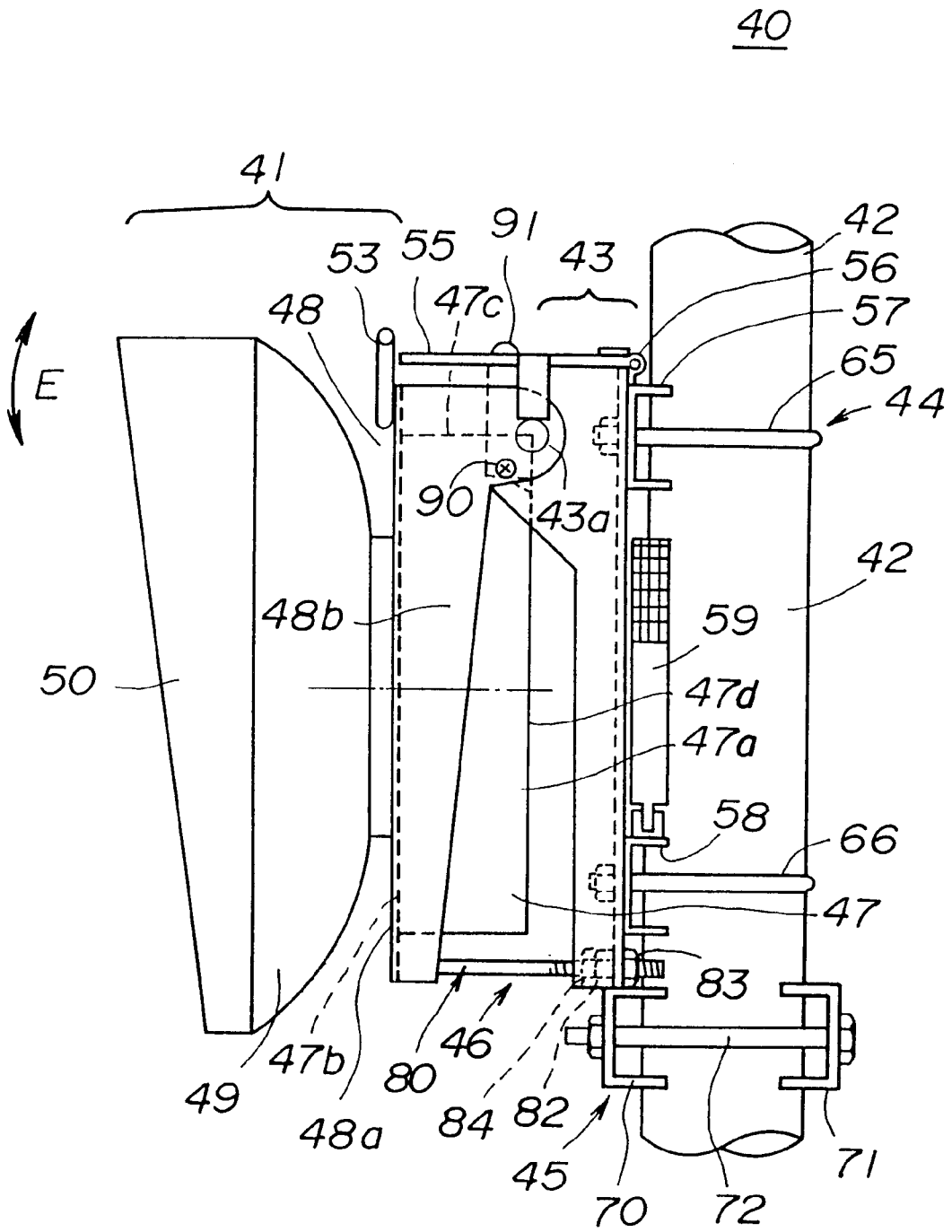
FIG. 4 is a diagram showing a side view of the embodiment of the antenna unit according to the present invention.
Figure 5:
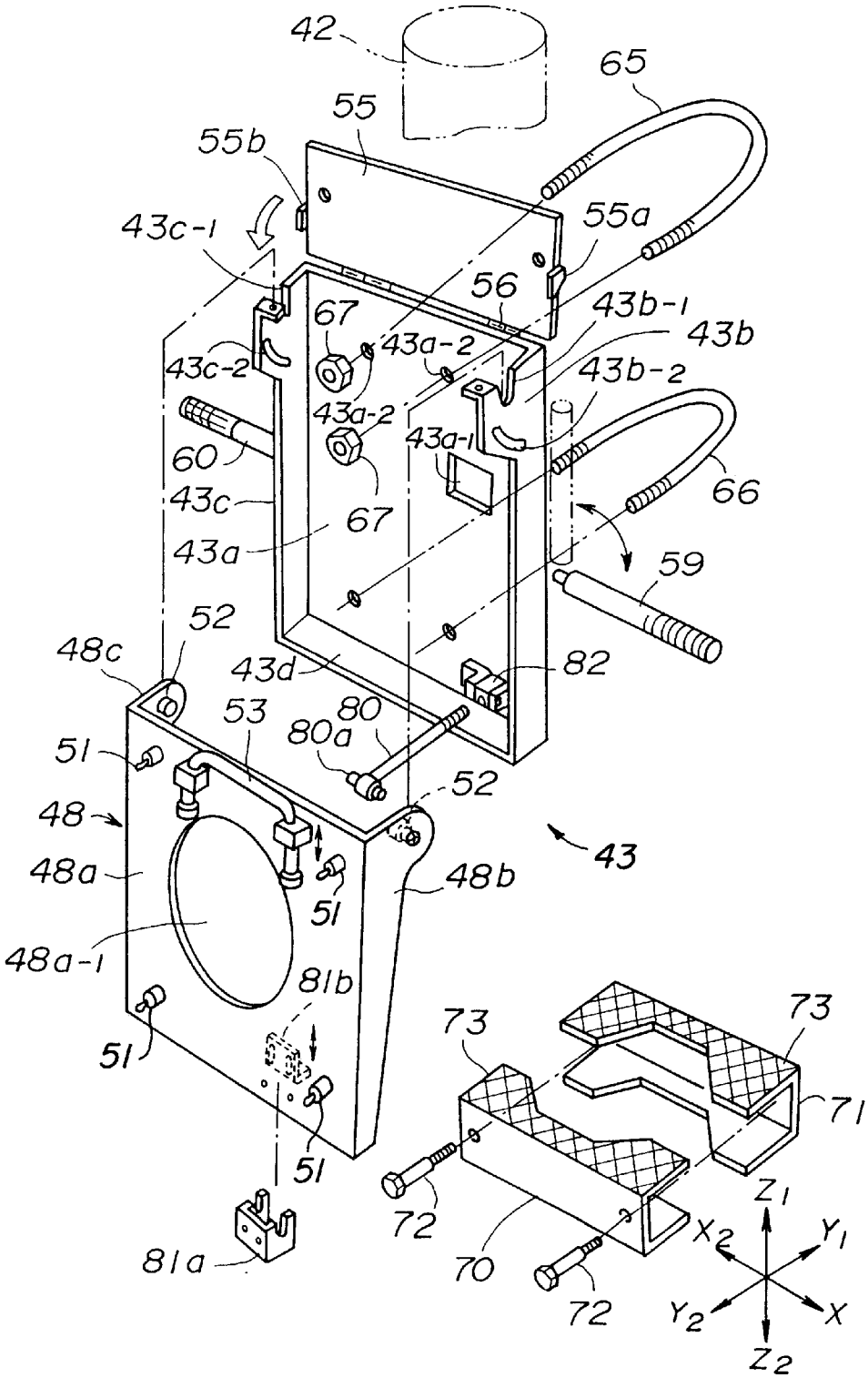
FIG. 5 is a diagram showing an exploded view of the embodiment of the antenna unit according to the present invention.

First, a description will be given of the embodiment of an antenna unit according to the present invention. FIG. 3 is a perspective view showing an antenna unit 40 of the present invention. FIG. 4 is a diagram showing a side view of the antenna unit 40 of the present invention and FIG. 5 is a diagram showing an exploded view of the antenna unit 40 of the present invention.

As shown in FIGS. 3 and 4, the antenna unit 40 has a structure in which an antenna integral-type radio transmitter-receiver apparatus 41 is fixed to a peripheral surface of a strut 42 which stands vertically and has a circular cross section.

Generally, the antenna unit 40 is comprised of a base mount metal member (a "base") 43 to be fixed to the strut 42, a fixing structural portion (a "clamp") 44 for making the base mount metal member 43 hold the strut 42 so as to be adjustable in a rotary direction around the strut 42, a supporting metal member structural portion 45 (a "base support") fixed to the strut 42 and supporting the base mount metal member 43 so that it will not slide down, the antenna integral-type radio transmitter-receiver apparatus 41 which is hooked by a hook portion 43*b*-1 (and 43*c*-1) of the base mount metal member 43, and an elevation adjustment mechanism 46 provided between the base mount metal member 43 and the antenna integral-type radio transmitter-receiver apparatus 41.

Since the antenna integral-type radio transmitter-receiver apparatus 41 is hooked by the hook ("pivotal connector") portions of the base mount metal member 43, it is possible to adjust the location of the antenna integral-type radio transmitter-receiver apparatus 41 by moving it forward or backward using the hook ("pivotal connector") portions 43*b*-1 and 43*c*-1 as a fulcrum during the setting-up.

The antenna integral-type radio transmitter-receiver apparatus 41 is comprised of a radio transmitter-receiver apparatus 47 put in a rectangular-shaped box, a hooking metal member ("carrier member") 48 fixed to a front portion of the radio transmitter-receiver apparatus 47 by screws, and an antenna 49 fixed to the front portion of the radio transmitter-receiver apparatus 47. A radome 50 is fixed to a front portion of the antenna 49. The weight of the antenna integral-type radio transmitter-receiver apparatus 41 is typically about 10 kilograms.

The hooking metal member 48 is comprised of a main body ("panel") 48*a* having a substantially square shape, and flanged portions 48*b* and 48*c* protruding in a $Y_1$ direction from the side portions of the main body 48*a*, i.e., in a direction toward the base mount metal member 43, as shown in FIG. 5. An opening 48*a*-1 for fixing the antenna 49 to the front portion of the radio transmitter-receiver apparatus 47 is formed in the central portion of the main body 48*a*. Pins 52 used as hooked ("pivotal connector") portions are fixed to the respective flanged portions 48*b* and 48*c*. A handle 53 for carrying the antenna integral-type radio transmitter-receiver apparatus 41 is provided with the main portion 48*a*. The handle 53 is normally in a pushed-down state and is pulled up when used. Each of the flanged portions 48*b* and 48*c* provides a space for fixing the respective pin 52 thereto and at the same time covers a portion of a side surface 47*a* of the radio transmitter-receiver apparatus 47. On the other hand, a front surface 47*b* of the radio transmitter-receiver apparatus 47 is covered by the main body 48*a*.

The base mount metal member 43 is comprised of a main portion ("panel") 43*a* having a substantially square shape a little larger than the radio transmitter-receiver apparatus 47, flanged portions 43*b* and 43*c* protruding from respective sides of the main portion 43*a* in a $Y_2$ direction, and another flanged portion 43*d* protruding from a lower side of the main portion 43*a* in a $Y_2$ direction as shown in FIG. 5. An awning cover 55 is fixed to the upper periphery (i.e., a top edge) of the main portion 43*a* by hinges 56. In a closed state, the awning cover 55 covers an upper surface 47*c* of the radio transmitter-receiver apparatus 47.

Hook portions 43*b*-1 and 43*c*-1 and holes (i.e., "slots") of an arc-shape 43*b*-2 and 43*c*-2 are formed in the respective flanged portions 43*b* and 43*c*. The awning cover 55 has lag portions 55*a* and 55*b*.

A window 43*a*-1 is formed in the main portion 43*a* so as to make a terminal portion and a display portion located at the back surface 47*d* of the radio transmitter-receiver apparatus 47 visible through it.

U-shaped metal members ("channels") 57 and 58, extending to $X_1$–$X_2$ direction as shown in FIG. 5, are fixed to respective upper and lower portions of the back of the main portion 43*a*, respectively.

Handles 59 and 60 which can be folded and used during the azimuth adjustment are fixed to respective, opposite sides of the U-shaped metal member 58 (FIGS. 4 and 5).

The fixing structural portion 44 has two U-shaped bolts 65 and 66. Each of the U-bolts holds the strut 42, penetrates the holes of the U-shaped metal members 57 and 58 and the holes 43*a*-2 of the main portion 43*a* of the base mount metal member 43, and fixed by nuts 67. Thus, the base mount metal member 43 is fixed to the strut 42 in a holding state by the two U-bolts 65 and 66.

The supporting metal member structural portion 45 is fixed by bolts 72 so as to make the U-shape metal members 70 and 71 ("pair of mating, bifurcated clamp halves") the strut 42. The upper surfaces of the U-shape metal members 70 and 71 are covered by a synthetic resin portion 73 in order to decrease sliding friction. The supporting metal member structural portion 45 supports the flanged portion 43*d* of the base mount metal member 43.

The elevation adjustment mechanism 46 is comprised of a substantially T-shaped bolt 80 having a head 80*a* whose shape is shown in FIG. 5, a bearing mechanism portion 81 located at the back of the main body 48*a* of the hooking metal member 48, a stand portion 82 with a hole fixed to the main portion 43*a* of the base mount metal member 43, and two nuts 83 and 84 which clamp the stand portion 82. The bearing mechanism portion 81 is comprised of a holding stand 81*a* and pressing member 81*b*. The bolt 80, whose head portion 80*a* is supported by the bearing mechanism portion 81, extends in a $Y_2$ direction and the other end penetrates the hole in the stand portion 82. The bolt 80 is fixed by the nuts 83 and 84 so as to clamp the stand portion 82.

After the completion of the elevation adjustment, screw 90 are fastened so that the flanged portions 48*b* and 48*c* of the hooking metal member 48 are fixed to the base mount metal member 43.

Thus the upper portion of the antenna integral-type radio transmitter-receiver apparatus 41 is fixed by the hook portions 43*b*-1 and 43*c*-1 hooking the pins 52 and by the screw 90, and the lower portion is fixed by the elevation adjustment mechanism 46 of which the nuts 83 and 84 are tightened.

The antenna unit 40 having the structure as described above is installed as follows:

(1) The supporting metal member structural portion 45 is firmly fixed to the strut 42 at the height at which the antenna integral-type radio transmitter-receiver apparatus 41 is to be set up;

(2) The fixing structural portion 44 (i.e., U-bolt clamps 65 and 66) is fixed to the strut 42 in a state that the base mount metal member 43 is mounted (i.e., supported) on the supporting metal member structural portion 45. The direction of the base mount metal member 43 is adjusted, roughly, to the direction of the antenna 49. The nuts 67 are fastened (i.e., tightened) to a degree that the base mount metal member 43 can be rotated a little;

(3) The pins 52 are engaged with the hook portions 43*b*-1 and 43*c*-1 so that the antenna integral-type radio transmitter-receiver apparatus 41 is supported on the front side of the base mount metal member 43;

(4) The awning cover 55 is closed and fixed by the screws 91;

(5) The elevation adjustment mechanism 46 is assembled so that the elevation adjustment can be carried out anytime;

(6) The azimuth adjustment is performed; and (7) The elevation adjustment is carried out.

Next, the azimuth adjustment according to the present invention will be described.

The azimuth adjustment is performed by operating the terminal portion located at the back 47*d* of the radio transmitter-receiver apparatus 47 through the window 43*a*-1, pulling down the handles 59 and 60, holding the handles 59 and 60 and rotating the base mount metal member 43 together with the antenna integral-type radio transmitter-receiver apparatus 41 in the direction indicated by the arrow A, checking the display portion through the window 43*a*-1 and stopping the base mount metal member 43 at the position where the value indicated by the display portion is maximum, and tightening the nuts 67.

Although the nuts 67 are not completely fastened during the azimuth adjustment, there is no danger that the antenna integral-type radio transmitter-receiver apparatus 41 may slide down since the flanged portion 43*d* (bottom flange) of the base mount metal member 43 is mounted on and supported by the metal member structural portion 45, in turn firmly fixed to the strut 42. Thus, the azimuth adjustment may be carried out safely.

Also, since the flanged portion 43*d* of the base mount metal member 43 slides on the synthetic resin portion 73 having a low friction coefficient, it is possible to move the antenna integral-type radio transmitter-receiver apparatus 41 by applying relatively low force thereto, compared with the case where no such resin portion 73 is used. Thus, the azimuth adjustment may be performed smoothly.

Moreover, the antenna integral-type radio transmitter-receiver apparatus 41 can easily be moved using the handle 53. Thus, the operation of the above (3) may be effectively carried out.

Further, the operation of the above (3) can be simply performed by hooking the pins 52 by the respective hook portions 43*b*-1 and 43*c*-1. Thus, the procedure described in the above (3) can be carried out without a troublesome operation such as fastening of screws.

Further, the danger that the antenna integral-type radio transmitter-receiver apparatus 41 falls down is eliminated by carrying out the above operation (3) followed by the operation (4) and the safety of the entire operation is guaranteed. This is because the awning cover 55 is closed and fixed by screws so that each of the lag portions 55*a* and 55*b* is engaged with a respective pin 52 so that the pin 52 will not come off (i.e., escape from) the hook portions 43*b*-1 and 43*c*-1.

In addition, the base mount metal member 43 is also functions as a part of an awning cover by covering the back portion 47*d* of the antenna integral-type radio transmitter-receiver apparatus 41 in a working state.

Next, the elevation adjustment according to the present invention will be described.

The elevation adjustment is performed by fastening one of the nuts 83 and 84 and loosening the other while checking the display portion through the window 43*a*-1. By this operation, the distance between the base mount metal member 43 of the bolt 80 and hooking metal member 48 is varied and the antenna integral-type radio transmitter-receiver apparatus 41 is rotated around the pin 52 in a direction indicated by the arrow E. Thus, the position of the antenna integral-type radio transmitter-receiver apparatus 41 is changed little by little and the operation is stopped when an indicated value of the display portion becomes maximum. The adjustment is completed by tightening the nuts 83 and 84 so as to firmly clamp the stand portion 82 and by fastening the screws 90.

It is obvious that the present invention is not limited to the above-mentioned embodiments, and variations and modifications may be made without departing from the scope of the present invention.

What is claimed is:

1. An antenna unit, comprising:

an antenna integral-type radio transmitter-receiver apparatus having a hooked portion;

a base affixable in a holding state to a strut and having a corresponding hook portion, said antenna integral-type radio transmitter-receiver apparatus being fixed to said base by engaging said hooked portion thereof with said hook portion; and said base further comprising a cover, with lag portions, supported by a hinge to an upper edge portion of the base, said cover being closed after said antenna integral-type radio transmitter-receiver apparatus is fixed to said base and thereby covering an upper portion of said antenna integral-type radio transmitter-receiver apparatus and said lag portions pressing against said hooked portion while engaged with said hook portion of said base.

2. The antenna unit according to claim 1, further comprising a supporting metal member fixed to said strut so as to support said base thereon.

3. An antenna unit comprising:

an antenna integral-type radio transmitter-receiver apparatus having a hooked portion;

a base affixable in a holding state to a strut and having a corresponding hook portion, said antenna integral-type radio transmitter-receiver apparatus being fixed to said base by engaging said hooked portion thereof with said hook portion;

a clamp rotatably coupling the base to the strut;

said base further comprising a cover, with lag portions, supported by a hinge to an upper edge portion of the base, said cover being closed after said antenna integral-type radio transmitter-receiver apparatus is fixed to said base and thereby covering an upper portion of said antenna integral-type radio transmitter-receiver apparatus and said lag portions pressing against said hooked portion while engaged with said hook portion of said base; and an elevation adjustment mechanism adjusting an elevation of said antenna integral-type radio transmitter-receiver apparatus.

4. The antenna unit according to claim 3, further comprising a supporting metal member fixed to said strut so as to support said base thereon.

5. An assembly for mounting an integral-type antenna and radio transmitter-receiver to a strut, the strut defining a strut axis and the assembly comprising:

a base support element selectively attachable to the strut at a desired axial position;

a base having a main panel, parallel side flanges and a bottom flange integral with the main panel and a cover hinged to an upper edge of the main panel for pivotal movement about a hinge axis between a closed position engaging respective top edges of the parallel side flanges and a raised, open position, the side flanges having respective pivotal connector portions therein adjacent the upper edges thereof and the bottom flange being received on an upper surface of the base support element and being moveable relatively thereto in rotation about the strut axis;

a clamp element receivable about the strut and secured to the base, selectively in a loose engagement permitting rotation of the base about the strut axis and in a rigid engagement preventing movement of the base relatively to the strut;

a carrier member having a main panel and a pair of side flanges integral therewith and having respective top edges, the side flanges having respective pivotal connector portions adjacent to the top edges thereof and selectively engageable with the respective pivotal connector portions of the base side flanges and thereby to support the carrier member on the base and to define a carrier axis of rotation affording rotation of the carrier relatively to the base; and an adjustment mechanism interconnecting the carrier and the base and selectively controlling an extent of rotation of the carrier relatively to the base, for affixing the carrier member at a selected, rotated position relatively to the base.

6. The mounting assembly as claimed in claim 5, wherein the carrier member supports a radio transmitter-receiver on an interior surface of the main panel thereof, opposed to the base, and an antenna extending from an exterior surface of the main panel thereof, as an integral-type unit, and affords transporting same, as an integral-type unit, to and from engagement with the base.

7. The mounting assembly as claimed in claim 6, wherein the carrier member further comprises a retractable handle mounted on the exterior surface of the main panel adjacent the upper edge thereof.

8. The mounting assembly as claimed in claim 5, wherein the base support element comprises a pair of mating, bifurcated clamp halves having corresponding central cutouts therein, of a common concave configuration, for surrounding and engaging respective, opposite surface portions of the strut.

9. The mounting assembly as claimed in claim 5, wherein the clamp element comprises:

a pair of clamps connected to the main panel of the base at spaced locations, each clamp comprising a U-shaped bolt receivable about the strut and selectively secured to the base main panel.

10. The mounting assembly as claimed in claim 9, wherein each clamp further comprises a channel member of a U-shaped cross section having a central wall extending between integral, parallel sidewalls, the central wall secured to the outside surface of the base main panel and the parallel sidewalls of the channel member projecting away therefrom and having aligned, concave cutouts therein for engaging a sidewall surface of the strut.

11. The mounting assembly as claimed in claim 5, wherein:

the respective pivotal connector portions of the base comprise respective, aligned notches in the parallel side flanges of the base, extending downwardly from the corresponding top edges thereof; and the pivotal connector portions of the carrier member comprise aligned pins secured to the respective side flanges of the carrier member and received respectively in the corresponding, aligned notches of the parallel side flanges of the base.

12. The mounting assembly as claimed in claim 11, wherein the adjustment mechanism comprises an elongated element having a first end pivotally secured to a bottom portion of an inside surface of the carrier member and extending to and through a receiving element affixed on a corresponding, opposed portion of an interior surface of the main panel of the base and adjustable, relatively thereto, for rotating the carrier member relatively to the base and for affixing the carrier member at the selected, rotated position relatively to the base.

13. The mounting assembly as claimed in claim 11, wherein the cover further comprises a pair of lags, extending from the corresponding side edges of and transversely to the cover, positioned so as to be aligned with the corresponding pins and thereby securing the pins in the respective notches in the closed position of the cover.

14. The mounting assembly as claimed in claim 13, wherein the side flanges of the base have integral tabs extending laterally from the top edges thereof and having corresponding holes therein aligned with respective holes in the cover for passing securing elements therethrough to secure the cover to the side flanges in the closed position of the cover.

* * * * *